United States Patent [19]

Yuzawa et al.

[11] Patent Number: 4,829,960

[45] Date of Patent: May 16, 1989

[54] ENGINE IDLE CONTROL SYSTEM FOR INTERNAL COMBUSTION ENGINE

[75] Inventors: Haruo Yuzawa; Yasuo Seimiya, both of Yokohama, Japan

[73] Assignee: Nissan Motor Co., Ltd., Yokohama, Japan

[21] Appl. No.: 870,886

[22] Filed: Jun. 5, 1986

[30] Foreign Application Priority Data

Jun. 10, 1985 [JP] Japan ..... 60-125812

[51] Int. Cl.[4] ..... F02M 1/00

[52] U.S. Cl. ..... 123/339; 123/340; 123/360

[58] Field of Search ..... 123/339, 340, 360

[56] References Cited

U.S. PATENT DOCUMENTS

| | | | |
|---|---|---|---|
| 3,645,241 | 2/1972 | Huntzinger | 123/360 |
| 4,176,633 | 12/1979 | McCabe | 123/360 |
| 4,181,104 | 1/1980 | Shinoda | 123/360 |
| 4,274,376 | 6/1981 | Tsiang | 123/360 |
| 4,491,107 | 1/1985 | Hasegawa | 123/339 |
| 4,522,175 | 6/1985 | Kamifugi | 123/339 |
| 4,523,561 | 6/1985 | Kosuge | 123/339 |
| 4,545,348 | 10/1985 | Ikeura | 123/339 |
| 4,546,744 | 10/1985 | Bonfiglioli | 123/339 |
| 4,580,535 | 4/1986 | Danno | 123/339 |

FOREIGN PATENT DOCUMENTS

| | | | |
|---|---|---|---|
| 57-195831 | 12/1982 | Japan | 123/339 |

*Primary Examiner*—Raymond A. Nelli

*Attorney, Agent, or Firm*—Foley & Lardner, Schwartz, Jeffery, Schwaab, Mack, Blumenthal & Evans

[57] ABSTRACT

In order to ensure that idling control is assuredly provided when the engine is subject to cold starts and the like, a solenoid which controls the modulation of a pressure signal via which a vacuum operated servo unit is controlled, is arranged to be fed an energization signal having a maximum energizing effect when a parameter indicative of the engine being started or having just been started is detected.

7 Claims, 4 Drawing Sheets

ENGINE IDLE CONTROL SYSTEM FOR INTERNAL COMBUSTION ENGINE

BACKGROUND OF THE INVENTION

1. Field of the Invention

The present invention relates generally to internal combustion engines and more specifically to a throttle valve control arrangement for controlling the engine speed during idling thereof.

2. Description of the Prior Art

FIG. 1 of the drawings shows an arrangement disclosed in Japanese Patent Application First Provisional Publication No. 57-195831/1964. This arrangement includes an engine idle control arrangement wherein the position of the engine throttle valve 1 is modified via the provision of a servo device. As shown this device includes a vacuum motor 3, the vacuum chamber 4 of which is selectively supplied vacuum from the induction passage 5 via a solenoid controlled valve 6. In the illustrated arrangement the vacuum motor includes a diaphragm 7 which partitions a housing 8 into the above mentioned vacuum chamber 4 and an ambient pressure chamber 9 and which has a stopper rod 10 connected thereto. This rod 10 is arranged to cooperate with an adjust lever 11 which is connected to the shaft (no numeral) of the throttle valve. With this arrangement upon vacuum being supplied to the vacuum chamber 4 the diaphragm 7 flexes in a manner to pull the rod 10 and thus rotate the throttle valve 1 by a predetermined small amount. Upon the level of vacuum falling toward atmospheric a return spring 12 disposed in the vacuum chamber 4 pushes the rod 10 to the left as seen in the drawings and thus permits the throttle valve 1 to assume a more restrictive position.

The solenoid valve 6 includes a valve seat 13 and valve element 14. That latter mentioned element 14 is moved under the control of a solenoid 15. An orifice 16 of a predetermined diameter is disposed so as bleed air into the passage 17 which interconnects the solenoid valve 6 and the vacuum chamber 4. The time for which the valve is open and vacuum from the induction passage 5 permitted to be supplied to the vacuum chamber 4 is determined in accordance with the duty cycle of the signal via which the solenoid 15 is energized. In this arrangement the valve element is fully opened when the duty cycle is 100% and fully closed when the duty cycle is 0%. At values between these two limits the amount of vacuum which is supplied to the vacuum chamber is modulated by the open and closing timing of the valve and the diameter of the air-bleed.

The solenoid 15 is operatively connected with a control arrangement which includes a control circuit 16 (including a microprocessor—by way of example) which is supplied data from an engine speed sensor 17, a vehicle speed sensor 18 and an engine coolant temperature sensor 19. In accordance with this data a suitable duty cycle valve is determined.

With this arrangement when the engine temperature is relatively high the duty cycle is lowered as compared with the fixed value which is used when the engine temperature is below an predetermined value.

Interposed between the control circuit 16 and the solenoid 15 are two switches 17, 18 which are arranged in parallel. The first of these switches (17) is arranged to be closed when a transmission associated with the engine (not shown) controlled by the instant device is conditioned to assume a neutral gear while the second switch (18) is connected with a clutch which provides a drive connection between the engine and the transmission. This second switch 18 is arranged to assume a closed position when the clutch assumes a condition wherein rotational energy between the engine and the transmission is not transmitted.

Thus, when either of switches is closed the solenoid 15 and the control circuit 16 are operatively connected.

However, this arrangement suffers from the drawback that when the engine stops oily residues which tend to collected in the induction passage 5 find their way into conduit 19 and eventually reach the valve seat 13 During the same time small amounts of dust and the like tend to enter the valve via the orifice 16. These small soil particles in combination with the sticky residue which has reached the valve seat 13 form a mass which when warm is relatively plastic but which when cool hardens and forms a gum which tends to "glue" the valve element to the valve seat.

When the engine is subject to a cold start, as the duty cycle of the signal which is applied to the solenoid 15 is low the amount of force produced by the solenoid is relatively low and is often insufficient to pull the valve element free 14 of the valve seat 13. Under these conditions vacuum cannot be supplied to the vacuum chamber 4 and the idling control is prevented.

SUMMARY OF THE INVENTION

It is an object of the present invention to provide an engine idle control arrangement which is free of the above mentioned drawback.

In brief, the above object is achieved by an arrangement wherein in order to ensure that idling control is assuredly provided when the engine is subject to cold starts and the like, a solenoid which controls the modulation of a pressure signal via which a vacuum operated servo unit is controlled, is arranged to be fed an energization signal having a maximum energizing effect when a parameter indicative of the engine being started or having just been started is detected.

More specifically, a first aspect of the present invention takes the form of, an internal combustion engine including an induction system, the induction system including a throttle valve which is movable in response to a manually derived command signal from a closed position toward an open one; and a device for controlling the position of the throttle valve when the manually derived command signal is absent and the engine is idling; the device comprising: a control valve which modulates a vacuum pressure signal derived from the induction system in a manner to form a first control signal, the control valve having a solenoid; a servo operatively connected with the throttle valve, the servo being responsive to the vacuum pressure signal and the control signal; a first sensor for sensing a first engine operational parameter; a control circuit responsive to the first sensor, the control circuit issuing an energization signal which is supplied to the solenoid, the control circuit including means for causing the energization signal applied to the solenoid to have a maximum value when the first sensor indicates that the engine is one of being started and has just been started.

A second aspect of the present invention comes in an automotive vehicle having an engine, the engine including an induction system having a throttle valve; a transmission; clutch means interconnecting the engine and transmission for selectively transmitting rotational energy from the engine to the transmission; and an engine idle control arrangement operatively connected with the throttle valve for controlling the position thereof, the engine idle control valve arrangement comprising: (a) a servo-motor operatively connected with the throttle valve, the servo motor including: a vacuum chamber which is supplied vacuum from the induction system; a control pressure chamber; and valve means responsive to the pressure in the control pressure chamber for modifying the level of vacuum in the vacuum chamber; (b) a modulation valve, the modulation valve modifying a vacuum signal which originated in the induction system to form the control signal, the modulation valve including a solenoid for moving a valve element thereof; (c) sensor means for sensing predetermined vehicle operational parameters; and (d) a control circuit responsive to the sensor means for controlling the energization of the modulation valve solenoid.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENT

Figure 1:
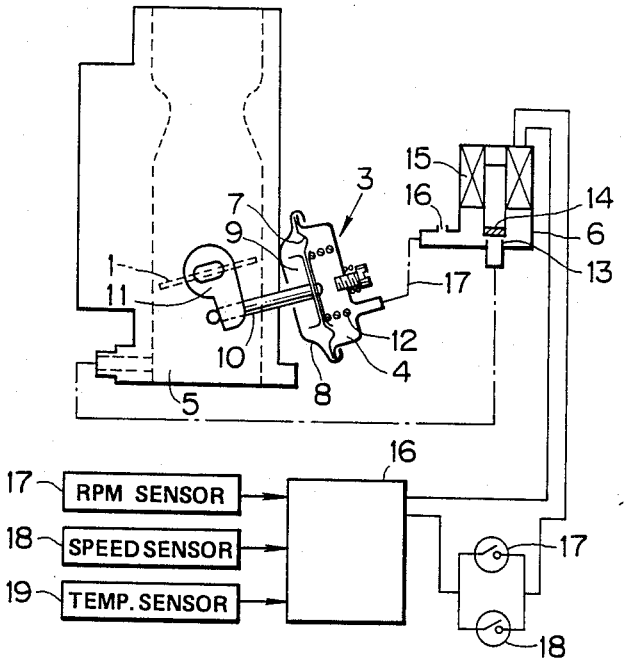
FIG. 1 (PRIOR ART)
FIG. 1 shows the prior art arrangement discussed in the opening paragraphs of the instant disclosure.
Figure 6:
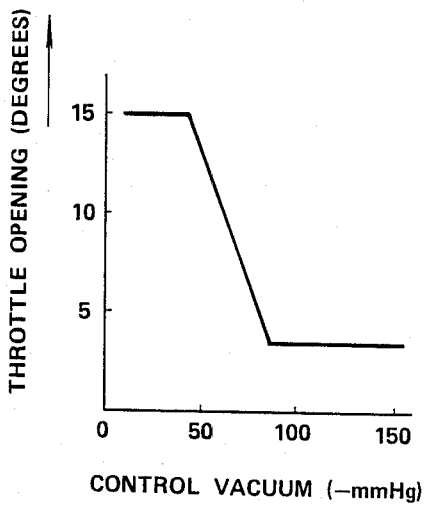
FIGS. 3 to 7 are graphs depicting the operational characteristics of the present invention.
Figure 7:
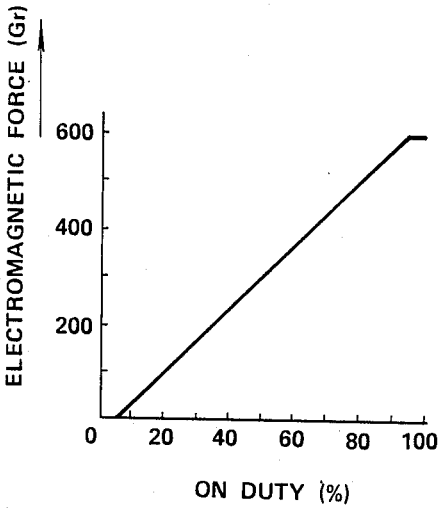
Figure 2:
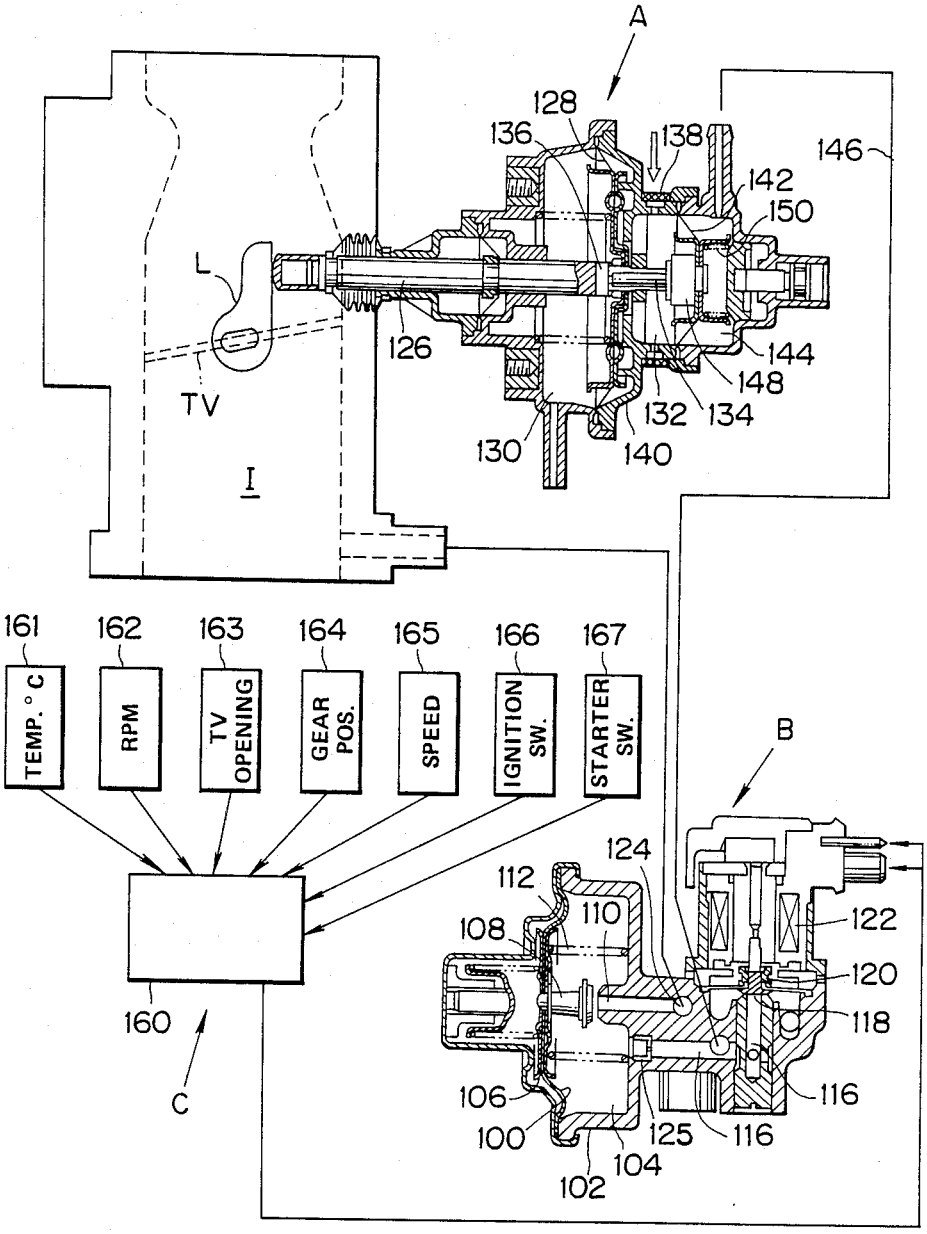
FIG. 2 shows an embodiment of the present invention.

FIG. 2 shows an embodiment of the present invention. This arrangement is comprises of three major sections: a vacuum operated servo unit "A" which modifies the position of the engine throttle valve "TV" during idling; a VCM valve "B" which modulates the control pressure which is supplied to the servo unit and a control unit "C" which derives the duty cycle which should be applied to the solenoid valve of the VCM valve B.

In this embodiment the VCM valve B includes a section which modulates the level of vacuum fed thereto to an essentially constant level. This section includes a diaphragm 100 which divides one end of the valve housing 102 into a vacuum chamber 104 and an ambient pressure chamber 106. A valve element 108 is fixed to the diaphragm 100 and arranged to cooperate with a port 110 in constant fluid communication with the induction passage "I" in a manner that as the vacuum in the vacuum chamber 104 increases above a predetermined limit the diaphragm 100 on which the valve 108 element is supported flexes again a return spring 112 and the valve element 108 approaches the port 110 to restrict the communication between the chamber 104 and the induction passage I. When the vacuum level drops the diaphragm 100 is moved under the influence of the return spring 112 in a direction to open port 110. This modulates the level of vacuum prevailing in the vacuum chamber 104 to an essentially constant level.

The VCM valve B is formed with a passage structure 116 which communicates with an atmospheric pressure bleed port 118 with the vacuum chamber 104. This port 118 is controlled by a soleniod valve arrangement including a valve element 120 which is constantly biased to close the port and which can be lifted from this position via energization of a solenoid coil 122.

An orifice 124 is disposed in the end of the passage structure 116 which communicates with vacuum chamber 104. With this arrangement when the atmospheric bleed port 118 is briefly opened via energization of the solenoid 122 the level of vacuum in the passage structure 116 is reduced. By controlling the time for which the atmospheric pressure bleed port 118 is open the level of vacuum in the passage structure can be modulated to a desired level. Description of this control will be given herein later.

The servo unit A includes a power section which is directly supplied unmodified vacuum from the induction passage and a control section which is supplied control pressure from the VCM valve. This control pressure is tapped off from a control pressure supply port 125 which is formed through the housing of the VCM valve A in a manner to communicate with the passage structure 116.

In more detail, the serve unit A includes a push rod 126 which is fixed to a main diaphragm 128 which divides the first section of the servo unit into a vacuum chamber 130 and an ambient pressure chamber 132. The push rod 126 and diaphragm 128 are biased in a direction which moves the push rod 126 into the unit and in a direction which permits the throttle valve TV to rotate toward a fully closed position.

The inboard end of the push rod 126 is arranged to sealingly pass through the diaphragm 128 and project into the ambient pressure chamber 132. This end of the rod is formed with intersecting bores 134, 136 which provide fluid communication between the vacuum chamber 130 and the ambient pressure chamber 132. The ambient pressure chamber 132 communicates with the atmosphere via a filter element 138 which is disposed about the housing 140 of the device.

The control section of this unit contains an arrangement which selectively opens controls the communication between the ambient pressure chamber 132 and the end of the bore 134 which opens thereinto.

This arrangement includes a diaphragm 142 which partitions the control section of the servo unit in a manner to define a sealed chamber 144 which fluidly communicates with the passage structure 116 of the VCM valve B via conduit 146. This diaphragm 142 supports a valve element 148 which is arranged to abut the end of the push rod 126 and close the bore 134. A return spring 150 biases the diaphragm 142 and valve element 148 toward the end of the push rod 126.

With the arrangement disclosed herein above, the vacuum supplied to vacuum chamber 130 of the power section of the servo unit A, induces the diaphragm 128 to flex in a direction which moves the push rod 126 out of the unit and against the throttle valve lever L in a manner which tends to crack the throttle valve TV and thus increase the engine speed level. However, upon moving to the point that valve element 148 separates from the end of the push rod 126, atmospheric air is permitted to pass through the bores 134, 136 formed therein and dilute the vacuum prevailing in the vacuum chamber 130. This of course terminates the stroke of the push rod 126.

By controlling the level of control vacuum supplied to chamber 144 the position at which the valve element 148 separates from the end of the push rod 126 can be selectively varied. Accordingly, by appropriately controlling the level of control vacuum the amount by which the throttle valve TV is opened can be accurately controlled.

The control section C of the instant embodiment includes a control unit 160 which in this instance includes a microprocessor. This latter mentioned element includes a RAM, ROM, CPU and a I/O interface or interfaces.

The control unit 160 is supplied data from an engine coolant temperature sensor 161, an engine rotational speed sensor 162, a throttle position sensor 163, a gear position sensor 164, a vehicle speed sensor 165, a sensor 166 which detects the condition of the engine ignition switch; and a sensor 167 which detects whether the engine is being cranked or not. As the construction and operation of each of the above mentioned sensors are well known to those skilled in the art of automotive engine control, no detailed disclosure of the same will be given for brevity.

The ROM of the microprocessor contains control programs which control the energization of the solenoid in accordance with the data receive from the above mentioned plurality of sensors.

Figure 3:
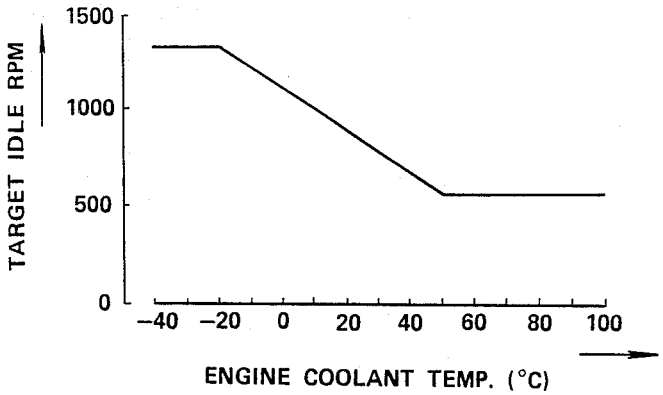
Figure 4:
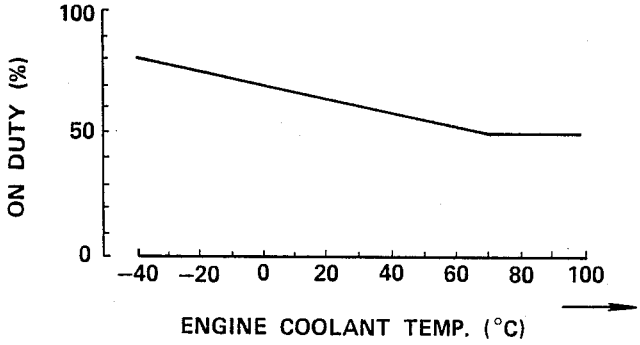
Figure 5:
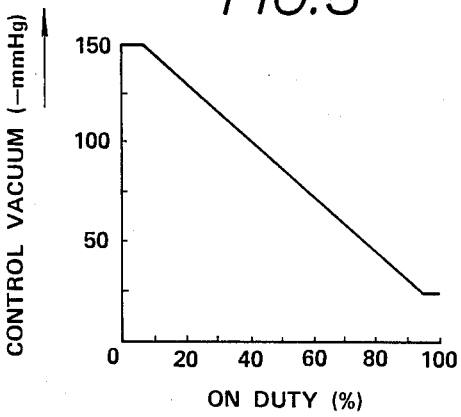
Figure 8:
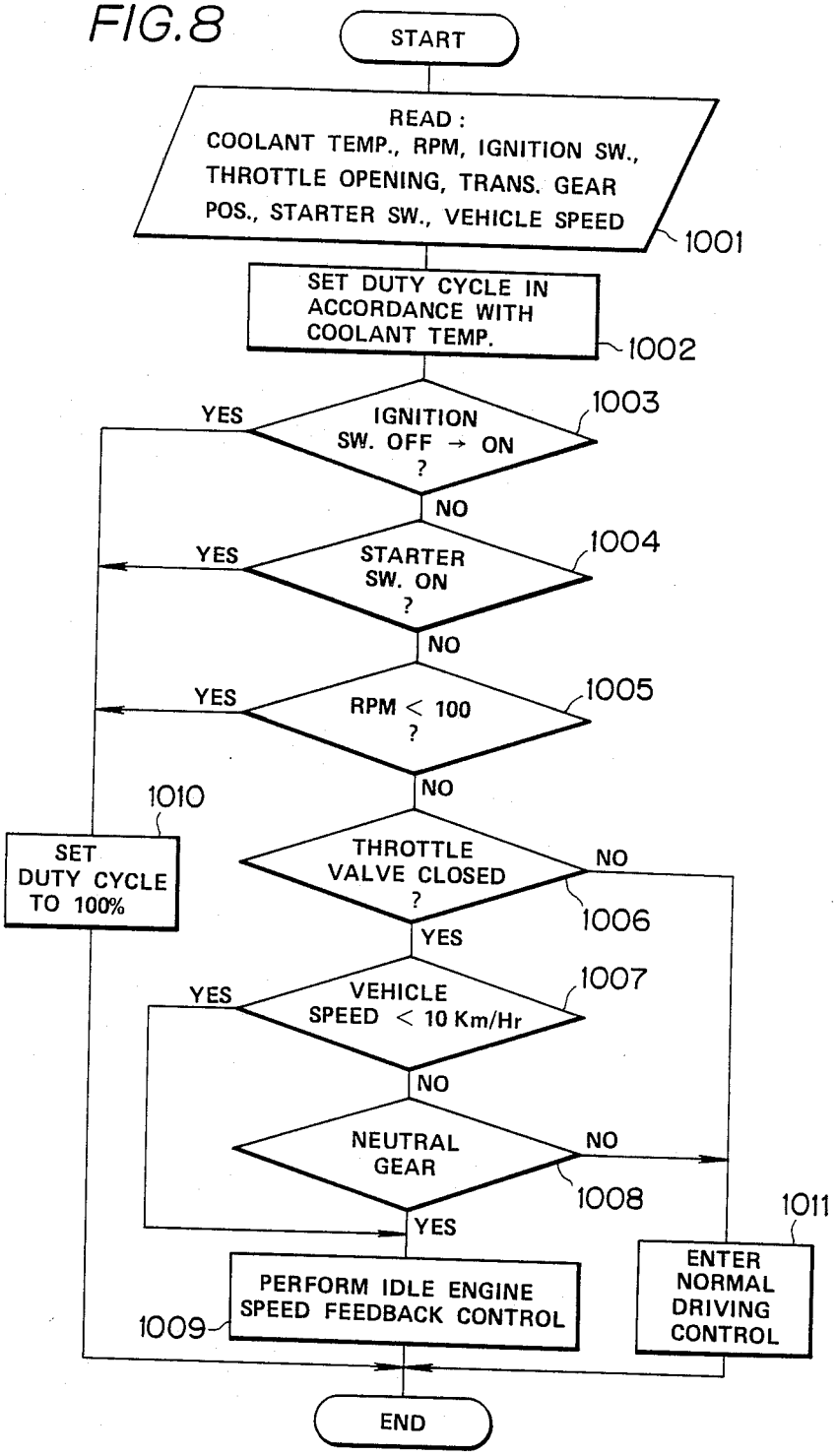
FIG. 8 is a flow chart showing the steps which characterize the control of the arrangement shown in FIG. 2.

FIG. 8 shows, in flow chart form, the steps which are executed during the control of the instant embodiment. As shown, in step 1001 the data from the various sensors is read and temporarily set in RAM. At step 1002 the duty cycle of the signal to be applied to the solenoid is determined in accordance with the instant coolant temperature. Data such as that given in FIGS. 3 and 4 can be used for this determination. Viz., it is possible by logging this data in table look-up form or via formulating a suitable algorithm, the engine speed and duty cycle which are necessary for the instant set of temperature conditions can be readily determined. In the event that the setting of the various springs has changed or the like the drift in control characteristics can be compensated for by comparing the engine speed with the desired value and updating the value of duty cycle which need be applied to solenoid.

Following this at step 1003 it is determined if the engine is being, or is about to be, started. Viz., it is determine if the ignition switch has been moved from an OFF position to an ON one. If the outcome of this enquiry is positive then the routine flows immediately to step 1010 wherein the value of the duty cycle to be applied is set to 100%.

At steps 1004 and 1005 similar enquiries are carried out. Viz., if the engine is being cranked or the engine speed is below a predetermined minimum value (e.g. 100 RPM) then the program similarly flows to step 1010. This ensures that as the engine is being started the maximum amount of power is applied to valve element 120 by solenoid 122 and the maximum throttle valve opening is achieved. This latter feature of course facilitates ready ignition of the charge in the combustion chambers and tends to raise the engine speed to a level whereat stalling is obviated and rapid engine warm-up promoted.

At step 1006 the current status of the throttle valve TV is determined. In the event that the throttle valve is not being manually operated by depression of the vehicle accelerator pedal or like manually operable member, then the program flows to step 1007 wherein the instant vehicle speed is sampled and compared with a predetermine value. In this instance if the vehicle speed is found to be below 10 Km/Hr then at step 1008 the condition of the transmission is checked to determine if it is in neutral gear.

If at steps 1006 or 1008 it is discovered that the engine throttle valve is closed or the transmission is not in neutral gear then at step 1011 a command to operate the solenoid according to a "normal driving" control schedule is issued and the routine ends.

On the other hand, if the routine flows to step 1009 then it is assumed that the engine is in a state which requires idling speed control and that control of the solenoid should be conducted in a manner to bring the engine speed to a value suitable for the instant set of operating conditions. Accordingly, a command which induces said control is issued.

With the instant embodiment as the valve element 108 automatically separates from the mouth of port 110 when the engine stops the chances of said element sticking in place is almost non-existent while with the arrangement of the air-bleed control valve, as the solenoid 122 of this element is energized with a 100% duty cycle signal when the engine is initially being started, the resulting powerful energization of solenoid ensures reliable trouble free operation of the system.

The above described embodiment is illustrative of the invention which may be modified with the scope of the appended claims.

What is claimed is:

1. In a automotive vehicle:

an internal combustion engine having an induction system;

a throttle valve disposed in said induction system, said throttle valve being movable in response to a manually derived command signal to move between a closed position and an open position; and a device for controlling the position of said throttle valve when the manually derived command signal is absent and the engine is idling; said device comprising:

a control valve which modulates a vacuum pressure signal derived from said induction system in a manner to form a control signal, said control valve having a solenoid;

a servo operatively connected with said throttle valve, said servo being responsive to said vacuum pressure signal and said control signal, said servo being arranged to be motivated by said vacuum pressure signal and so that the amount of motivation by said vacuum pressure signal is subject to control by said control signal;

a first sensor for sensing a first engine operational parameter;

control means responsive to said first sensor, for (a) issuing an energization signal which has a duty cycle and which is supplied to said solenoid and (b) for causing the energization signal applied to said solenoid to have a substantially maximum duty cycle when said first sensor indicates that the engine is being started.

2. In a automotive vehicle (i) an engine, said engine including an induction system having a throttle valve;

(ii) a transmission;

(iii) clutch means interconnecting said engine and transmission for selectively transmitting rotational energy from said engine to said transmission;

(iv) an ignition system including an ignition switch and a starter switch; and (v) an engine idle control arrangement operatively connected with the throttle valve for controlling the position thereof, said engine idle control valve arrangement comprising:

(a) a servo motor operatively connected with said throttle valve, said servo motor including:

a vacuum chamber which is supplied vacuum from said induction system;

a control pressure chamber; and valve means responsive to the pressure in said control pressure chamber for modifying the level of vacuum in said vacuum chamber;

(b) a modulation valve, said modulation valve modifying a vacuum signal which originated in said induction system to form said control signal, said modulation valve including a solenoid for moving a valve element thereof;

(c) sensor means for sensing predetermined vehicle operational parameters; and (d) a control circuit responsive to said sensor means for controlling the energization of the solenoid of said modulation valve;

wherein said control circuit includes means for determining if the ignition switch is on, and if one of (a) the starter motor switch is on and (b) the engine rotational speed is below a predetermined level.

3. In an automotive vehicle:

an internal combustion engine having an induction system;

a throttle valve disposed in said induction system, said throttle valve being movable in response to a manually derived command signal to move between a closed position and an open position; and a device for controlling the position of said throttle valve hen the manually derived command signal is absent and the engine is idling; said device comprising:

a control valve which modulates a vacuum pressure signal derived from said induction system in a manner to form a control signal, said control valve having a solenoid;

a servo operatively connected with said throttle valve, said servo being responsive to said vacuum pressure signal and said control signal;

a first sensor for sensing a first engine operational parameter;

control means responsive to said first sensor, for (a) issuing an energization signal which has a duty cycle and which is supplied to said solenoid and (b) for causing the energization signal applied to said solenoid to have a substantially maximum duty cycle when said first sensor indicates that the engine is one of being started and has just been started;

wherein said sensor means includes a first sensor for sensing a temperature which varies with the temperature of the engine, a second sensor for sensing the rotational speed of said engine, a third sensor for the position of said throttle valve, a fourth sensor for sensing said transmission having been conditioned to assume a neutral gear, a fifth sensor for sensing vehicle speed, a sixth sensor for sensing the status of the engine ignition switch, and a seventh sensor for sensing whether the engine is being cranked or not.

4. In an automotive vehicle an engine idle control arrangement which is operatively connected to a throttle valve of the engine for controlling the position thereof, comprising:

a servo motor operatively connected with said throttle valve, said servo motor comprising:

a vacuum chamber which is fluidly connected with a source of vacuum;

a control pressure chamber; and valve means responsive to the pressure in said control chamber for modifying the level of vacuum in said vacuum chamber;

a modulation valve for producing a control signal which is supplied to said control chamber, said modulation valve comprising:

a control pressure supply port, said control pressure supply port fluidly communicating with said control chamber;

an orifice, said orifice being fluidly disposed in passage which leads from said control pressure supply port to said source vacuum;

an atmospheric air bleed port, said atmospheric air bleed port fluidly communicating with said passage at a location between said orifice and said control pressure supply port; and a solenoid valve for controlling said atmospheric air bleed port, said solenoid valve being arranged to be controlled by an energization signal having a duty cycle and to increase the amount of air permitted to pass through said atmospheric air bleed port as the duty cycle of said energization signal is increased;

sensor means for sensing operational parameters of said engine; and control means responsive to said sensor means for applying an energization signal to said solenoid valve which has a substantially maximum duty cycle when the engine is being started and has just been started.

5. In an automotive vehicle:

an internal combustion engine having an induction system;

a throttle valve disposed in said induction system, said throttle valve being movable in response to a manually derived command signal to move between a closed position and an open position; and a device for controlling the position of said throttle valve when the manually derived command signal is absent and the engine is idling; said device comprising:

a control valve which modulates a vacuum pressure signal derived from said induction system in a manner to form a control signal, said control valve having a solenoid, said control valve being arranged so that when said solenoid is energized with a signal having a high duty cycle the control pressure exhibits a low vacuum value and when said solenoid is energized with a low duty cycle the control pressure exhibits a high vacuum value;

a servo operatively connected with said throttle valve, said servo being responsive to said vacuum pressure signal and said control signal, said servo being arranged to be maximally responsive to said pressure signal in a direction which tends to open said throttle valve when said control signal exhibits a low vacuum value and to be minimally responsive to said pressure signal when said control signal exhibits a high vacuum value;

a first sensor for sensing a first engine operational parameter;

control means responsive to said first sensor, for (a) issuing an energization signal which has a duty cycle and which is supplied to said solenoid and (b) for causing the energization signal applied to said solenoid to have a substantially maximum duty cycle when said first sensor indicates that the engine is being started.

6. An automotive vehicle as claimed in claim 1, wherein said first engine operational parameter comprises cranking of the engine.

7. An automotive vehicle as claimed in claim 1, wherein said first engine operational parameter comprises engine rotational speed and wherein said control means is responsive to the engine rotational speed being below a predetermined value in manner to induces said energization signal to have said substantially maximum value.

* * * * *